US008642114B2

(12) United States Patent
Bitterich et al.

(10) Patent No.: US 8,642,114 B2
(45) Date of Patent: Feb. 4, 2014

(54) PRINTING MATERIAL COATING SYSTEM AND METHOD FOR OPERATING THE SYSTEM

(75) Inventors: Wolfgang Bitterich, Gemmingen (DE); Bernd Heller, Neckargemünd (DE); Michael Schwand, Heidelberg (DE)

(73) Assignee: Heidelberger Duckmaschinen AG, Heidelberg (DE)

( * ) Notice: Subject to any disclaimer, the term of this patent is extended or adjusted under 35 U.S.C. 154(b) by 609 days.

(21) Appl. No.: 12/606,263

(22) Filed: Oct. 27, 2009

(65) Prior Publication Data

US 2010/0104759 A1 Apr. 29, 2010

(30) Foreign Application Priority Data

Oct. 27, 2008 (DE) ..... 10 2008 053 340

(51) Int. Cl.
*B05D 1/36* (2006.01)

(52) U.S. Cl.
USPC ..... 427/8; 427/256

(58) Field of Classification Search
USPC ..... 427/265, 8, 256, 421.1; 118/255, 712; 222/145.2, 135; 239/305, 112
See application file for complete search history.

(56) References Cited

U.S. PATENT DOCUMENTS

| | | | | |
|---|---|---|---|---|
| 4,375,865 | A * | 3/1983 | Springer | 222/135 |
| 5,060,861 | A * | 10/1991 | Holt | 239/124 |
| 6,857,367 | B2 | 2/2005 | Heller et al. | |
| 2008/0097273 | A1 * | 4/2008 | Levin et al. | 604/6.09 |

FOREIGN PATENT DOCUMENTS

| | | | |
|---|---|---|---|
| DE | 296 16 686 | U1 | 11/1996 |
| DE | 297 22 601 | U1 | 2/1998 |
| DE | 197 57 094 | A1 | 6/1999 |
| DE | 102 46 946 | A1 | 5/2003 |
| EP | 0 924 074 | A1 | 6/1999 |
| GB | 2 332 394 | A | 6/1999 |
| JP | 11342593 | A | 12/1999 |
| JP | 2003182032 | A | 7/2003 |
| JP | 2005052717 | A | 3/2005 |
| JP | 2006131286 | A | 5/2006 |
| JP | 2008008590 | A | 1/2008 |

OTHER PUBLICATIONS

German Patent and Trademark Office Search Report, dated Apr. 6, 2009.

* cited by examiner

*Primary Examiner* — Michael Cleveland
*Assistant Examiner* — Alex A Rolland
(74) *Attorney, Agent, or Firm* — Laurence A. Greenberg; Werner H. Stemer; Ralph E. Locher

(57) ABSTRACT

A system for coating printing materials with coating fluids and a method for operating the system include, in a first step, coating printing material with a first coating fluid using a coating device of the system and keeping a first feed device of the system connected to the coating device for feeding the first coating fluid to the coating device using the first feed device. In a second step following the first step, printing material is coated with a second coating fluid using the coating device and a second feed device of the system is kept connected to the coating device for feeding the second coating fluid to the coating device using the second feed device. In a third step carried out after the first step and, at least to some extent, during the second step, the first feed device is flushed through with a cleaning fluid.

3 Claims, 2 Drawing Sheets

PRINTING MATERIAL COATING SYSTEM AND METHOD FOR OPERATING THE SYSTEM

CROSS-REFERENCE TO RELATED APPLICATION

This application claims the priority, under 35 U.S.C. §119, of German Patent Application DE 10 2008 053 340.8, filed Oct. 27, 2008; the prior application is herewith incorporated by reference in its entirety.

BACKGROUND OF THE INVENTION

Field of the Invention

The present invention relates to a method for operating a system for coating printing materials with coating fluids and to a system for coating printing materials with coating fluids which is suitable for implementing the method.

Printing materials, that is sheets or webs, for example of paper or board, are coated with coating fluids, for example printing inks or varnishes. For that purpose, use is made of systems which include a printing press or varnishing machine and peripheral devices assigned to the machine. Disposed in the machine is a coating device, through the use of which the fluid is metered and transferred to the printing material. Such a coating device can include a chamber-type doctor and one or more rollers. The peripheral device can include a vessel in which there is a supply of fluid. In addition, it can include a pump and connecting hoses in order to pump the fluid from the vessel into the chamber-type doctor.

Such a system is described in German Utility Model DE 29616686 U1. The prior art system has a first circuit for emulsified varnish and a second circuit for UV varnish. A metering device can be supplied as desired with the emulsified varnish and the UV varnish and a cleaning fluid reservoir can be incorporated into the first or second circuit, through the use of appropriate activation of control valves.

A further coating system for printing materials is described in German Published, Non-Prosecuted Patent Application DE 102 46 946 A1. The system has circulation lines for the coating fluid, into which a liquid cleaning medium can also be introduced.

In the known systems, the cleaning is comparatively time-consuming and cumbersome.

SUMMARY OF THE INVENTION

It is accordingly an object of the invention to provide a printing material coating system and a method for operating the system, which overcome the hereinafore-mentioned disadvantages of the heretofore-known systems and methods of this general type and with which quick and simple cleaning is achieved.

With the foregoing and other objects in view there is provided, in accordance with the invention, a method for operating a system for coating printing materials with coating fluids. The method comprises, in a first step, coating printing material with a first coating fluid using a coating device of the system while keeping a first feed device of the system connected to the coating device for feeding the first coating fluid to the coating device with the first feed device. In a second step following the first step, printing material is coated with a second coating fluid using the coating device while keeping a second feed device of the system connected to the coating device for feeding the second coating fluid to the coating device with the second feed device. In a third step carried out after the first step and at least to some extent during the second step, the first feed device is flushed through with a cleaning fluid.

This method permits automated cleaning of the first feed device during a printing operation that is running with the incorporation of the second feed device. This is very user-friendly and maintenance time is saved.

In accordance with another mode of the method of the invention, the coating device is separated from the first feed device and connected to the second feed device, between the first step and the second step. In a further mode, the first feed device is short-circuited, between the first step and the third step. In this case, a check can be made to see whether the short-circuiting of the first feed device has been carried out correctly in that, through the use of at least one pump belonging to the first feed device, a vacuum is generated in the latter and that vacuum is monitored through the use of a sensor, with any incorrectness of the short-circuiting being detected on the basis of a drop in or lack of buildup of the vacuum. In this case, provision can also be made for the first feed device to be flushed through with the cleaning fluid only when the correctness of the short-circuiting has been confirmed by the checking.

With the objects of the invention in view, there is also provided a system for coating printing materials with coating fluids. The system comprises a coating device for coating the printing materials with a first coating fluid and a second coating fluid, a first feed device for feeding the first coating fluid to the coating device, a second feed device for feeding the second coating fluid to the coating device, and a device for simultaneously:

- closing a first circuit for a cleaning fluid, the first circuit incorporating the first feed device, and
- forming a second circuit for the second coating fluid, the second circuit incorporating the second feed device and the coating device.

Through the use of this system, the method according to the invention can be carried out in such a way that quick and simple cleaning is ensured.

In accordance with another feature of the system of the invention, the device for closing the first circuit is a connecting link for short-circuiting two lines belonging to the first circuit. The connecting link can be constructed to be compatible with connections of the two lines, which are disposed at an interface. It is possible for there to be a monitoring device which monitors whether or not the connecting link has been connected correctly to the two lines. In this case, the first circuit can have at least one pump for pumping the first coating fluid, and the monitoring device can have a sensor for detecting a drop in or lack of buildup of a vacuum generated by the pump. In a further feature, the device for closing the first circuit is a control valve device for short-circuiting two lines belonging to the first circuit. This control valve device can be disposed immediately before an interface of the two lines which is formed by connections.

Other features which are considered as characteristic for the invention are set forth in the appended claims.

Although the invention is illustrated and described herein as embodied in a printing material coating system and a method for operating the system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
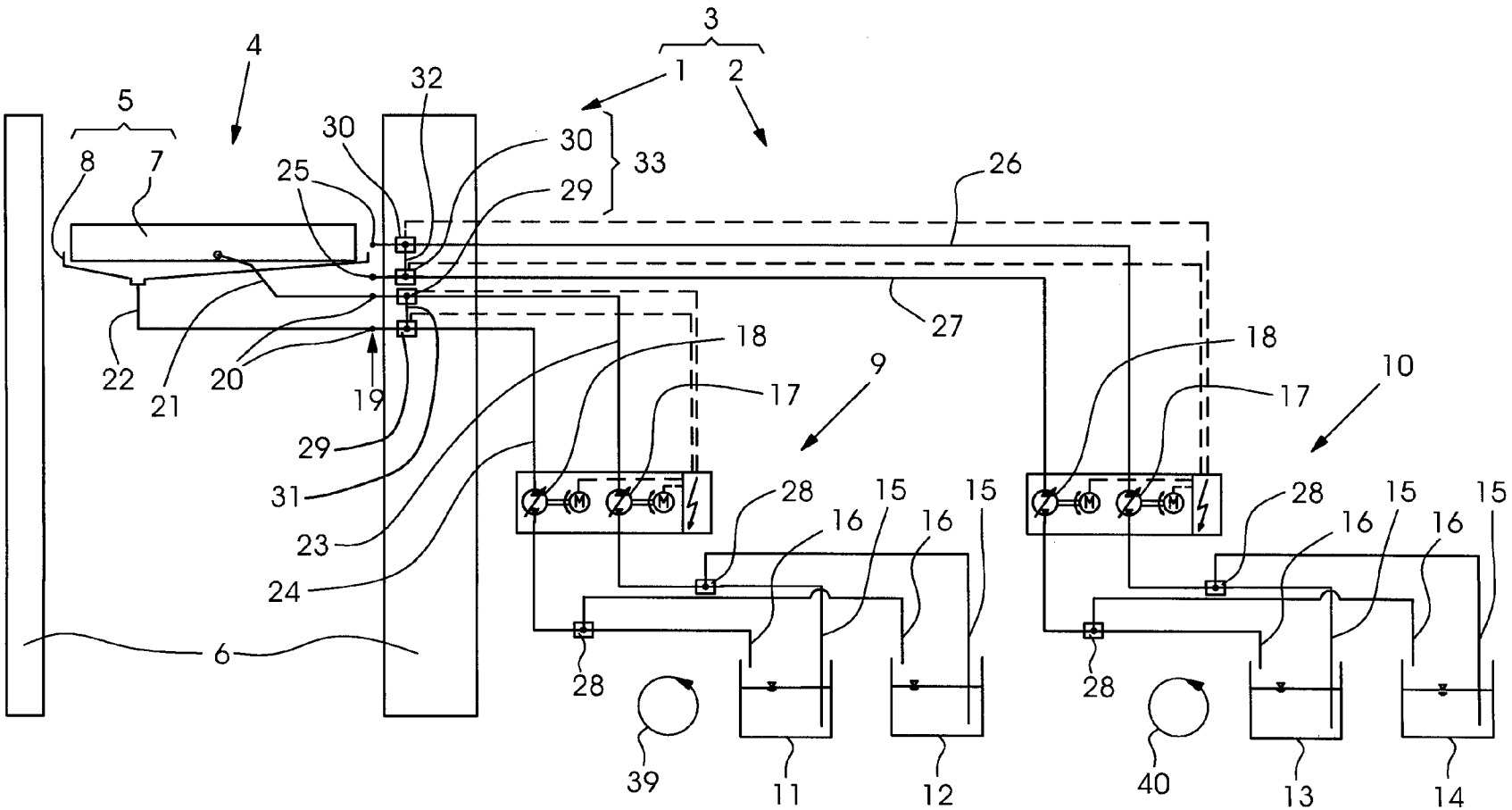
FIG. 1 is a schematic and diagrammatic, longitudinal-sectional view of a first exemplary embodiment of the invention, having a coating system with two fluid circuits, of which one is short-circuited through the use of a control valve device in a cleaning mode.
Figure 2:
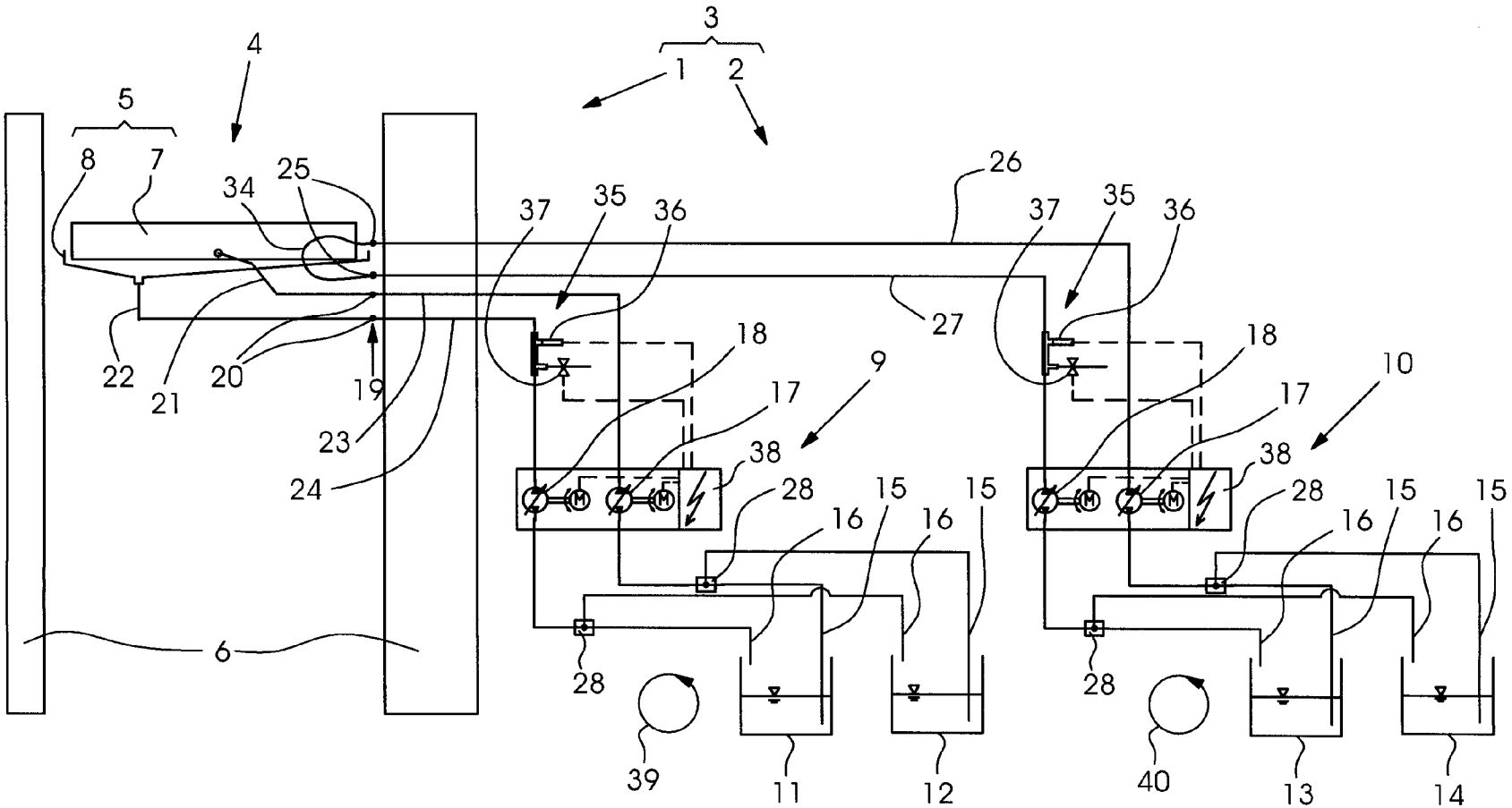
FIG. 2 is a view similar to FIG. 1 of a second exemplary embodiment having a coating system with two fluid circuits, of which one is short-circuited through the use of a connecting link in a cleaning mode.

Referring now in detail to FIGS. 1 and 2 of the drawings, in which mutually corresponding elements and components are indicated by the same designations, there is seen a portion of a printing press 1 and a supply device 2 disposed beside the printing press, which together form a system 3 for coating preferably sheet printing materials. The figure shows a varnishing unit 4 belonging to the printing press 1, in which a coating device 5 is disposed. The coating device 5 is located in the interior of the printing press between lateral frame walls 6 and includes a non-illustrated engraved roll as a metering device having a chamber-type doctor 7 resting thereon and a collecting trough 8 disposed underneath. The supply device 2 is substantially not located between the frame walls 6 and includes a first feed device 9 for a first coating fluid, for example UV varnish, and a second feed device 10 for a second coating fluid, for example emulsified varnish.

The first feed device 9 includes a first container 11 for storing the first coating fluid and a second container 12 for storing a cleaning fluid. The second feed device 10 includes a third container 13 for storing the second coating fluid and a fourth container 14 for storing a cleaning fluid, which can be the same as in the second container 12 or preferably another one. Hose-like or tube-like lines 15 for delivering the fluids from the containers 11 to 14 dip into the respective fluid, and just such lines 16 for conveying the fluids back into the containers 11 to 14 open above the respective fluid level, which is indicated in the drawing.

Each feed device 9, 10 has a first pump 17 for the delivery of the respective coating fluid to the coating device 5, which is carried out during the printing operation, and a second pump 18 for conveying non-printed, excess coating fluid from the coating device 5 back into the respective container 11 or 13. The four pumps 17, 18 are each reversible pumps, that is to say pumps having a delivery direction which can be changed.

An interface 19 for liquid lines is disposed on one frame wall 6. The interface 19 includes connections 20, through which a feed line 21 of the chamber-type doctor 7 and a return line 22 from the collecting trough 8 can be connected to a feed line 23 and a return line 24 belonging to the first feed device 9. Furthermore, the interface 19 includes connections 25, through which the feed line 21 and the return line 22 can be connected to a feed line 26 and a return line 27 belonging to the second feed device 10. The feed lines 23, 26 are connected to the first pumps 17 of the feed devices 9, 10, and the return lines 24, 27 are connected to the second pumps 18. The connections 20, 25 can be constructed as half-couplings of quick-closure couplings, with complementary half-couplings being located on the hose-like lines 21, 22 of the coating device 5. The designation "28" designates selection or directional control valves, which are integrated into the part of the line system respectively lying between the containers 11, 12 and 13, 14 and the pumps 17, 18.

Following the preceding description of the common features of the two exemplary embodiments, the special features of the exemplary embodiment according to FIG. 1 will be described in more detail below.

In the system 3 illustrated in FIG. 1, selection or directional control valves 29 are integrated into the lines 23, 24 of the first feed device 9, and selection or directional control valves 30 are integrated into the lines 26, 27 of the second feed device 10. A connecting line 31 is disposed between the directional control valves 29, and a connecting line 32 is disposed between the directional control valves 30.

In a first switching position of the directional control valves 29, the first coating fluid flows from the feed line 23 through one directional control valve 29 into the feed line 21 and from the return line 22 through the other directional control valve 29 into the return line 24. In a second switching position of the directional control valves 29, the cleaning fluid flows from the feed line 23 through the two directional control valves 29 and the connecting line 31 located in between into the return line 24. The two lines 21, 22 can be detached from the connections 20 by the operator during conversion of the printing press 1 and coupled to the connections 25 of the other feed device 10. Instead, however, provision can also be made for the operator to replace the contaminated lines 21, 22 during the conversion, that is to say to remove them from the printing press 1 and to connect the coating device 5 to the connections 25 of the second feed device 10 through the use of new lines 21, 22.

Following the conversion, in a first switching position of the directional control valves 30, the second coating fluid can flow from the feed line 26 through one directional control valve 30 into the feed line 21 and from the return line 22 through the other directional control valve 30 into the return line 27. In a second switching position of the directional control valves 30 belonging to the second feed device 10, the cleaning fluid flows from the feed line 26 through one directional control valve 30 into the connecting line 32 and from the latter through the other directional control valve 30 into the return line 27.

The directional control valves 29, 30 of the two feed devices 9, 10 are disposed in the immediate vicinity of the connections 20, 25 and can be fixed to the frame wall 6 on which the interface 19 is disposed. The four directional control valves 29, 30 together form a control valve device 33 and, including the connecting lines 31, 32, can form a single spool valve having a corresponding number of switching positions, which is advantageous with regard to a compact construction and the ability to be operated remotely. The directional control valves 29, 30 can, however, also be constructed as ball valves which are separate from one another and can be operated by hand.

In the system 3 illustrated in FIG. 2, there is a connecting link 34, which is a piece of hose or tube. This connecting link 34 has a half-coupling at each of its two ends, which can be coupled to the connections 20, 25. In the simplest case, if the connections 20, 25 are formed as hose connectors, ends of the hoses of the connecting link 34, which can be plugged onto these hose connectors, form their half-couplings.

In a first operating mode, which is shown in FIG. 2, the lines 21, 22 of the coating device 5 are detached from the connections 25 of the second feed device 10 and are connected to the connections 20 of the first feed device 9, and the connections 25 of the second feed device 10 are connected to each other through the connecting link 34, so that the cleaning fluid can flow from the feed line 26 through the connecting link 34 into the return line 27. In this case, the cleaning fluid does not flow through the coating device 5, since the two lines 26, 27 are short-circuited with each other by the connecting link 34.

In a second operating mode, which is not illustrated in the drawing, the two lines 21, 22 of the coating device 5 are no longer connected to the connections 20 of the first feed device 9 but instead to the connections 25 of the second feed device 10, and the connecting link 34 is coupled to the connections 20, in order to connect the two lines 23, 24 to each other. In this case, the cleaning fluid flows from the feed line 23 through the connecting link 34 into the return line 24 of the first feed device 9.

The feed devices 9, 10 in each case include a monitoring device 35, which is used to monitor whether the connecting link 34 has been connected correctly to the respective connections 20 or 25. The monitoring device 35 registers leaks in the connection of the connecting link 34 and is disposed within the line system between the pumps 17, 18 and the respective connections 20 and 25 and more precisely in the respective return line 24 and 27. The monitoring device 35 includes a sensor 36 for detecting the vacuum generated in the return line 24 or 27 by the first pump 17.

A pneumatic valve 37 functioning as a venting device is likewise integrated into the respective return line 24 and 27. There is an electronic device controller 38 for each feed device 9, 10, which receives and processes signals from the sensor 36 and activates the pumps 17, 18, their motors and the pneumatic valve 37. The device controllers 38 have a control link to a central control device belonging to the printing press 1.

The operation of the systems shown in FIGS. 1 and 2 will be described below.

If, in the system illustrated in FIG. 1 and in the system illustrated in FIG. 2, the printing press 1 is printing, the first feed device 9 together with the coating device 5 forms a first circuit 39 for the first coating fluid from the first container 11. The first circuit 39 is indicated symbolically in the drawing. In this case, the delivery direction of the first pump 17 and the flow path of the directional control valve 28 integrated into the line 15 belonging to the first container 11 are set in such a way that the first pump 17 sucks the first coating fluid out of the first container 11 through the line 15 and pumps it into the chamber-type doctor 7 through the feed line 23 and the feed line 21. Some of the first coating fluid pumped into the chamber-type doctor 7 is passed on by the chamber-type doctor 7 to the engraved roll and consequently printed. The remaining part of the first coating fluid pumped into the chamber-type doctor 7 runs out of the chamber-type doctor 7 into the collecting trough 8 and is sucked out of the latter by the second pump 18 through the return line 22 and the return line 24. In the system 3 shown in FIG. 1, in this case the directional control valves 29 are switched through from the feed line 23 into the feed line 21 and from the return line 22 into the return line 24, with the flow path through the connecting line 31 being shut off. The second pump 18 pumps the excess first coating fluid back into the first container 11 through the line 16 belonging to the latter, with the directional control valve 28 of the line 16 having been switched to a setting permitting the flow from the return line 24 into this line 16. The pumps 17, 18 of the first feed device 9 therefore circulate the first coating fluid in the first circuit 39. Thus, the control valve device 33 and the connecting link 34 each form a device for closing a first circuit 39.

During this running printing operation, the second feed device 10 forms a second circuit 40 for the cleaning fluid from the fourth container 14. The cleaning fluid is circulated in the second circuit 40 chronologically parallel with the circulation of the first coating fluid in the first circuit 39, in order to flush clean the second feed device 10 not participating in the printing operation. In this case, the feed line 26 and the return line 27 are short-circuited with each other at their ends which are not connected to the coating device 5. This short-circuiting in the system 3 shown in FIG. 1 is effected by an appropriate setting of the control valve device 33, more precisely the directional control valves 30, and in the system 3 shown in FIG. 2 by the connecting link 34 connected to the connections 25. In this case, the directional control valves 30 are set in such a way that they free a flow path of the cleaning fluid from the feed line 26 through the connecting line 32 into the return line 27 and shut off flow paths of the cleaning fluid to the connections 25, so that no cleaning fluid can escape from the latter.

In the system 3 illustrated in FIG. 2, the hermetic coupling of the connecting link 34 is checked before the cleaning fluid is circulated in the second feed device 10. For the purpose of carrying out this checking, firstly residues of the second coating fluid from the feed line 26 and the return line 27 are pumped back into the third container 13, with the two pumps 17, 18 being operated with mutually opposite delivery directions. Accordingly, the fluid residues are sucked out of the feed line 26 by the first pump 17 and conveyed into the third container 13 through the line 15 belonging to the latter. The directional control valve 28 of the line 15 of the third container 13 in this case is switched to an appropriate setting. At the same time, the varnish or fluid residues are sucked out of the return line 27 by the second pump 18 and conveyed back into the third container 13 through the line 16 belonging to the latter.

Given correct seating of the connecting link 34, in this case a vacuum is generated in the line system formed from the feed line 26, the return line 27 and the connecting link 34, and is detected by the sensor 36. If this intended vacuum is built up within that line system, it is ensured that the connecting link 34 is connected properly to the connections 25.

Otherwise, extraneous or parasitic air would penetrate into the line system in the region of the connections 25 and lead to a drop in the vacuum, which would be detected by the sensor 36 and signaled to the device controller 38. The device controller 38 is able to indicate to the operator, acoustically or visually, that the connecting link 34 has not yet been coupled up correctly, so that the operator can carry out an appropriate correction.

If the connecting link 34 is seated correctly and the fluid residues have been pumped out of the lines 26, 27, the directional control valves 28 are changed over and the delivery direction of the first pump 17 is changed over, so that the cleaning fluid from the fourth container 14 is now circulated in the second circuit 40, in order to clean the latter thoroughly. During the circulation of the cleaning fluid, the pumps 17, 18 operate with the delivery direction being the same as each other, so to speak in tandem operation. This takes place during the printing operation running with the use of the first feed device 9. It is only in order to connect the connecting link 34 to the connections 25 that any interruption to the printing operation is necessary. This can be carried out, for example, during the conversion of the printing press 1 from one print job to another. The two exemplary embodiments according to FIGS. 1 and 2 do not differ from each other with respect to the circulation of the cleaning fluid in the short-circuited second circuit 40.

Once the second feed device 10 has been cleaned to the greatest extent, its first pump 17 is reversed again, so that the latter attempts to suck the feed line 26 empty. In this case, the pumps 17, 18 once more run with mutually opposite delivery directions. A vacuum is produced in the line system, is detected by the sensor 36 and signaled to the device controller 38, whereupon the latter opens the pneumatic valve 37, so that ambient air flows into the line system and the latter is emptied completely. Compressed air can also be used to assist the emptying, instead of the ambient air.

The two structurally identical feed devices 9, 10 can be used alternately for the printing operation. In each case the feed device 9 or 10, which is not participating actively in the printing operation, is flushed through with the cleaning fluid during the printing operation that is running by using the other feed device.

The invention claimed is:

1. A method for operating a system for coating printing materials with coating fluids, the method comprising the following steps:

in a first step, coating printing material with a first coating fluid using a coating device of the system while keeping a first feed device of the system connected to the coating device for feeding the first coating fluid to the coating device with the first feed device and circulating the first coating fluid in a circuit including the first feed device and the coating device;

in a second step following the first step, coating printing material with a second coating fluid using the coating device while keeping a second feed device of the system connected to the coating device for feeding the second coating fluid to the coating device with the second feed device;

in a third step carried out after the first step and at least to some extent during the second step, flushing through the first feed device with a cleaning fluid while operating a first reversible pump and a second reversible pump of the first feed device in the same delivery direction in tandem operation; and between the first step and the third step, short-circuiting the first feed device and checking to determine if the short-circuiting of the first feed device has been carried out correctly by generating a vacuum in the first feed device while operating the first reversible pump and the second reversible pump in mutually opposite delivery directions, monitoring the vacuum with a sensor, and detecting any incorrectness of the short-circuiting on a basis of a drop in or lack of buildup of the vacuum.

2. The method according to claim 1, which further comprises between the first step and the second step, separating the coating device from the first feed device and connecting the coating device to the second feed device.

3. The method according to claim 1, which further comprises flushing through the first feed device with the cleaning fluid only when the correctness of the short-circuiting has been confirmed by the checking step.

* * * * *